US009556665B2

(12) United States Patent
Ritzert et al.

(10) Patent No.: US 9,556,665 B2
(45) Date of Patent: Jan. 31, 2017

(54) DOOR SYSTEM AND METHOD OF MAKING

(71) Applicant: Pella Corporation, Pella, IA (US)

(72) Inventors: Joseph A. Ritzert, Pella, IA (US); Andrew Morse, Altoona, IA (US); Earl J. Ratcliff, New Sharon, IA (US); Cory Brown, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 14/622,108

(22) Filed: Feb. 13, 2015

(65) Prior Publication Data

US 2015/0233171 A1 Aug. 20, 2015

Related U.S. Application Data

(60) Provisional application No. 61/941,270, filed on Feb. 18, 2014.

(51) Int. Cl.

| | |
|---|---|
| ***E06B 1/52*** | (2006.01) |
| ***E06B 3/36*** | (2006.01) |
| ***E06B 3/10*** | (2006.01) |
| *E05D 5/04* | (2006.01) |

(52) U.S. Cl.

CPC ..... *E06B 1/524* (2013.01); *E06B 3/10* (2013.01); *E06B 3/365* (2013.01); *E05D 5/04* (2013.01); *E06B 3/36* (2013.01)

(58) Field of Classification Search

CPC ..... E06B 1/524; E06B 3/36; E06B 3/365; E06B 3/362; E06B 2003/7011; E05D 5/04

See application file for complete search history.

(56) References Cited

U.S. PATENT DOCUMENTS

| | | | | |
|---|---|---|---|---|
| 1,922,860 A * | 8/1933 | Powell | E06B 3/365 49/482.1 |
| 3,274,735 A * | 9/1966 | Stackhouse | E05D 5/023 49/504 |
| 3,503,169 A | 3/1970 | Johnson et al. | |
| 3,851,420 A | 12/1974 | Tibbetts | |
| 4,055,917 A | 11/1977 | Coller | |

(Continued)

FOREIGN PATENT DOCUMENTS

| | | | |
|---|---|---|---|
| FR | 2224632 | * 10/1974 | E06B 3/362 |

OTHER PUBLICATIONS

Andersen® Frenchwood® Hinged Patio Doors, 400 Series, Architectural Detail File, marked Rev. Mar. 2005, 21 pages.

(Continued)

*Primary Examiner* — Brian Mattei
*Assistant Examiner* — Catherine A Kelly
(74) *Attorney, Agent, or Firm* — Faegre Baker Daniels LLP

(57) ABSTRACT

According to some embodiments, a multi-panel door system includes a fixed panel and an active panel. Both panels are secured to the astragal of the door frame by securement members driven into and through hinges connected to the active panel, through the astragal, and into the fixed panel. The securement members are driven through a middle portion of the astragal stem in order to align the fixed and active panels in a recessed position with respect to the door frame. The fixed panel and the active panel are coplanar. Hinge support plates are placed between the hinges and the astragal and communicate forces transmitted through the securement members into deeper portions of the astragal.

13 Claims, 22 Drawing Sheets

(56) References Cited

U.S. PATENT DOCUMENTS

| | | | | | |
|---|---|---|---|---|---|
| 4,068,433 | A * | 1/1978 | Glover | E06B 7/231 | 52/207 |
| 4,087,942 | A * | 5/1978 | Herrmann | E05D 5/04 | 16/382 |
| 4,154,033 | A | 5/1979 | Krueger et al. | | |
| 4,185,416 | A | 1/1980 | Wilmes | | |
| 4,214,405 | A * | 7/1980 | Chupik | E06B 1/524 | 49/382 |
| 4,237,664 | A | 12/1980 | Wilmes | | |
| 4,292,771 | A | 10/1981 | Ellis | | |
| 4,310,991 | A | 1/1982 | Seely | | |
| 4,447,987 | A | 5/1984 | Lesosky | | |
| 4,502,249 | A * | 3/1985 | Banford | E05D 5/06 | 16/384 |
| 4,660,338 | A | 4/1987 | Wagner | | |
| 4,831,779 | A | 5/1989 | Kehrli et al. | | |
| 4,831,804 | A | 5/1989 | Sayer | | |
| 4,837,977 | A | 6/1989 | Mauro | | |
| 4,891,921 | A | 1/1990 | Governale | | |
| 4,974,364 | A * | 12/1990 | Durham, Jr. | E06B 1/366 | 49/400 |
| 4,974,366 | A | 12/1990 | Tizzoni | | |
| 5,018,307 | A | 5/1991 | Burrous et al. | | |
| 5,026,581 | A | 6/1991 | Shea, Jr. et al. | | |
| 5,044,121 | A | 9/1991 | Harbom et al. | | |
| 5,051,560 | A | 9/1991 | Fremaux et al. | | |
| 5,067,279 | A | 11/1991 | Hagemeyer | | |
| 5,081,793 | A * | 1/1992 | Mauro | E06B 3/325 | 49/501 |
| 5,123,212 | A | 6/1992 | Dallaire et al. | | |
| 5,174,065 | A | 12/1992 | Schlicht | | |
| 5,179,804 | A | 1/1993 | Young | | |
| 5,341,600 | A | 8/1994 | Heppner | | |
| 5,355,625 | A * | 10/1994 | Matsuoka | E06B 3/10 | 49/381 |
| 5,371,987 | A * | 12/1994 | Hirsch | E06B 1/045 | 49/239 |
| 5,675,947 | A * | 10/1997 | Yane | E06B 3/365 | 49/365 |
| 5,682,715 | A * | 11/1997 | McKann | E06B 1/16 | 49/504 |
| 5,687,508 | A | 11/1997 | Fitzhenry et al. | | |
| 5,822,923 | A * | 10/1998 | Governale | E06B 3/365 | 49/365 |
| 5,832,681 | A * | 11/1998 | Johnson | E06B 1/363 | 52/204.55 |
| 5,870,859 | A | 2/1999 | Kitada | | |
| 5,887,387 | A | 3/1999 | Dallaire | | |
| 6,219,917 | B1 | 4/2001 | Peed et al. | | |
| 6,219,971 | B1 | 4/2001 | Headrick | | |
| 6,293,049 | B1 * | 9/2001 | Shaw | E06B 1/366 | 49/183 |
| 6,334,283 | B1 * | 1/2002 | Edger | E06B 1/702 | 52/204.1 |
| 6,367,201 | B1 | 4/2002 | Massey et al. | | |
| 6,374,545 | B1 | 4/2002 | Baczuk | | |
| 6,374,557 | B1 | 4/2002 | O'Donnell | | |
| 6,430,889 | B1 * | 8/2002 | Nixon, Sr. | E06B 1/32 | 52/204.1 |
| 6,523,311 | B2 | 2/2003 | Edger | | |
| 6,665,989 | B2 | 12/2003 | Bennett | | |
| 6,722,089 | B2 * | 4/2004 | Budzinski | E06B 1/6007 | 52/204.1 |
| 6,883,279 | B2 | 4/2005 | Fukuro et al. | | |
| 7,000,959 | B2 * | 2/2006 | Sanders | E05B 15/0245 | 292/340 |
| 7,010,894 | B1 * | 3/2006 | Cappelle | E04B 9/26 | 52/384 |
| 7,263,808 | B2 * | 9/2007 | Massey | E05C 9/1808 | 52/204.1 |
| 7,266,929 | B1 | 9/2007 | Allred et al. | | |
| 7,481,028 | B2 | 1/2009 | Tufts et al. | | |
| D588,905 | S | 3/2009 | Meeks et al. | | |
| 7,552,562 | B2 | 6/2009 | Curtis et al. | | |
| 7,596,912 | B2 | 10/2009 | Ito et al. | | |
| 7,905,058 | B2 * | 3/2011 | Massey | E05C 7/04 | 49/365 |
| 8,001,736 | B2 | 8/2011 | Goldberg et al. | | |
| 8,074,409 | B2 | 12/2011 | Goldberg et al. | | |
| 8,074,410 | B1 | 12/2011 | Ryba | | |
| 8,127,500 | B2 | 3/2012 | Meeks et al. | | |
| 8,132,370 | B2 | 3/2012 | Heppner | | |
| 8,276,320 | B2 | 10/2012 | Erbrect et al. | | |
| 8,353,138 | B2 | 1/2013 | Sigmund et al. | | |
| 8,393,115 | B2 | 3/2013 | Schroder et al. | | |
| 8,713,854 | B2 | 5/2014 | Schroder et al. | | |
| 8,733,025 | B2 * | 5/2014 | Baumert | E06B 1/02 | 49/504 |
| 9,062,490 | B2 | 6/2015 | Kadavy et al. | | |
| 2006/0150521 | A1 | 7/2006 | Henry et al. | | |
| 2007/0218270 | A1 | 9/2007 | Huntress et al. | | |
| 2007/0227076 | A1 | 10/2007 | Braun | | |
| 2008/0120914 | A1 | 5/2008 | Fink et al. | | |
| 2008/0216424 | A1 | 9/2008 | Westphal et al. | | |
| 2009/0038231 | A1 | 2/2009 | Erbrect et al. | | |
| 2010/0162644 | A1 | 7/2010 | Campbell et al. | | |
| 2010/0192488 | A1 | 8/2010 | Campbell et al. | | |
| 2011/0047884 | A1 | 3/2011 | Schroder | | |
| 2011/0258947 | A1 | 10/2011 | Peterson | | |
| 2012/0005975 | A1 | 1/2012 | Kim | | |
| 2013/0247474 | A1 | 9/2013 | Schroder et al. | | |
| 2013/0312343 | A1 | 11/2013 | Markham | | |
| 2014/0041326 | A1 | 2/2014 | Kadavy et al. | | |
| 2015/0284988 | A1 | 10/2015 | Kadavy et al. | | |

OTHER PUBLICATIONS

Chapter 12, Clad Ultimate Inswing French Door, Marvin Architectural Detail Manual No. 11708608, marked with various dates, 42 pages.

Forimpex Offers You a New Product that meets the new Harmonized Standard NAFS-08 & Canadian Supplement CSA A440 S1-09, downloaded from http://www.forimpex.ca/en/best-contact, 1 page.

Installation Guide for Andersen® 400 Series Frenchwood® Hinged Patio Doors or 400 Series Frenchwood® Hinged Patio Doors with Stormwatch® Protection, Instruction Guide 0004234 BB, © 1997-2008, marked Revised Apr. 29, 2008, 12 pages.

Installation Instruction—Premium Wood Entry Door, Part Number: E829300, ©2008 Pella Corporation, 6 pages.

NAFS—North American Fenestration Standard/Specification for Windows, Doors, and Skylights, AAMA/WDMA/CSA 101/I.S.2/A440-08, Copyright 2008, downloaded from http://www.aamanet.org/upload/file/CMB-5-08.pdf.

Ramped Sill Insert for Andersen® Patio Doors, Instruction Guide 0004392, ©1996-2004, marked Revised Apr. 13, 2004, 6 pages.

Tru-Defense® Door System, © 2009 Therma-Tru, downloaded from http://www.thermatru.com, 1 page.

* cited by examiner

DETAIL D

DETAIL B

DOOR SYSTEM AND METHOD OF MAKING

RELATED APPLICATIONS

This application claims the benefit of U.S. Provisional Patent Application No. 61/941,270, entitled DOOR SYSTEM AND METHOD OF MAKING, filed on Feb. 18, 2014, the content of which is incorporated by reference in its entirety for all purposes.

TECHNICAL FIELD

Embodiments of the present invention relate generally to door systems and, in particular, to door systems incorporating multiple door panels.

BACKGROUND

Panels in many multi-panel door systems are offset, i.e., the outer or inner surfaces of the panels do not align within a plane. In addition, in many door systems the panels are recessed with respect to the door frame using fixed stops physically placed between the panels and the frame. The fixed stops are secured to the interior facing surfaces of the frame to secure the panels in their recessed positions. Replacing the panels in these systems is difficult and cumbersome.

SUMMARY

According to some embodiments, a multi-panel door system includes a fixed panel placed between a door jamb and an astragal of the door frame. The fixed panel is secured to the astragal by securement members driven through a middle section of the astragal and into the fixed panel. The multi-panel door system also includes an active panel placed between the opposite door jamb and the astragal. The active panel is pivotally coupled to the astragal using hinges fixed to the astragal by the securement members. The fixed panel and the active panel are coplanar. Hinge support plates are placed between the hinges and the astragal and communicate forces transmitted through the securement members into deeper portions of the astragal.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive. Unless specified otherwise, all measurements in the description and the illustrations are in inches.

Figure 1:
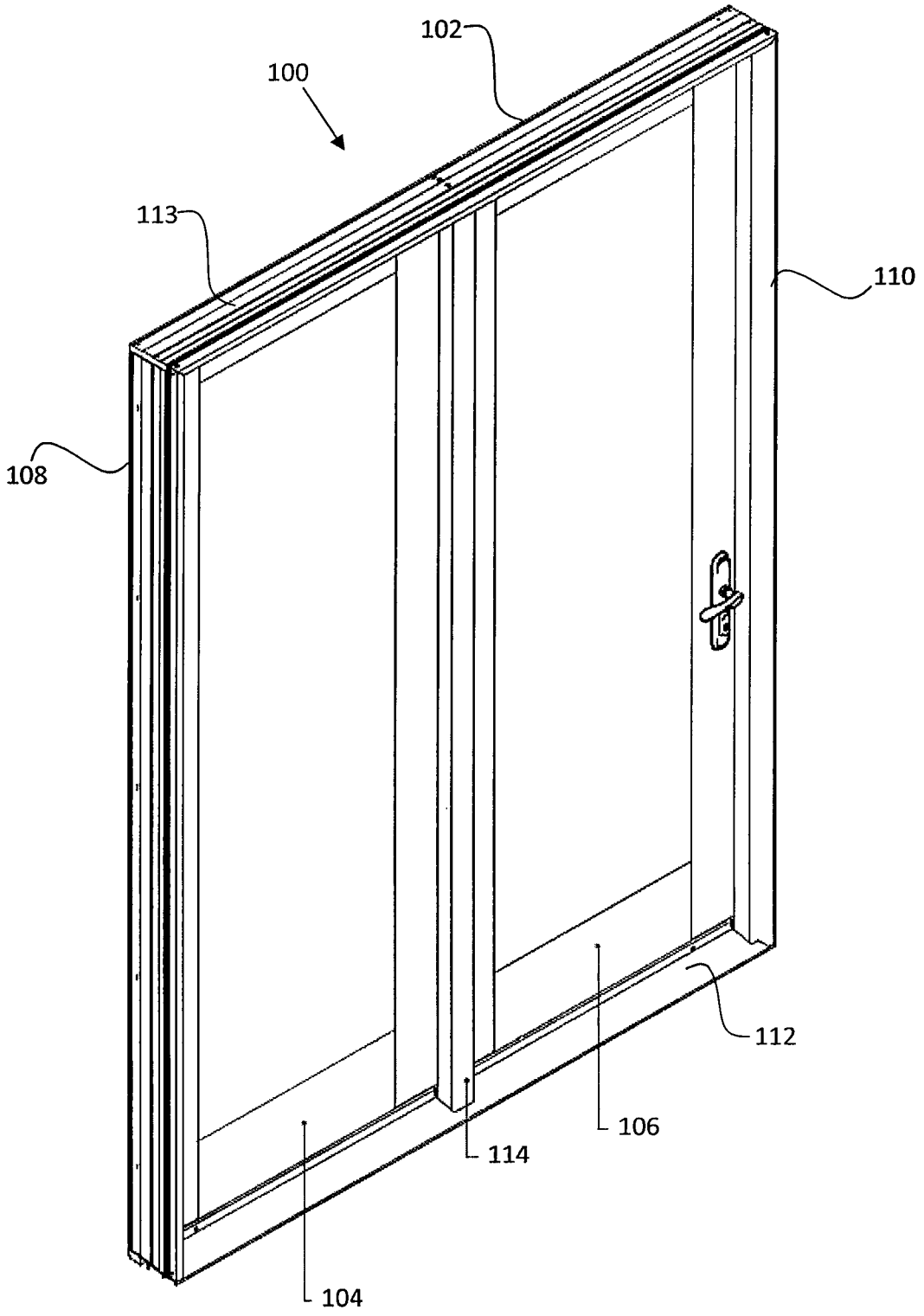
FIG. 1 is an elevated view of the exterior side of a multi-panel door system, in accordance with embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

According to some embodiments, and as shown in several figures, including FIG. 1, a multi-panel door system 100 includes a door frame 102, a first panel 104, and a second panel 106. The door frame 102 includes a first side jamb 108, a second side jamb 110, a sill 112, and a head 113. The door frame 102 also includes an astragal or astragal assembly 114 that is located between the first side jamb 108 and the second side jamb 110. The astragal 114 is fixed to the sill 112 and to the head 113. The first panel 104 is placed between the first side jamb 108 and the astragal 114 and the second panel 106 is placed between the astragal 114 and the second side jamb 110. As also shown in FIG. 1, and as detailed in FIG. 14, an outer surface 124 of the first panel 104 and an outer surface 126 of the second panel 106 are aligned within an outer panel plane 128. An inner surface 125 of the first panel 104 and an inner surface 127 of the second panel 106 are aligned within an inner panel plane 129. In some embodiments, the first panel 104 is a fixed panel 104 and the second panel 106 is a vent panel 106 or an active panel 106. A variety of panels may be used as either the first panel 104 and/or the second panel 106, such as door panels, sidelight panels, solid panels, and windowed panels, among others.

Figure 2:
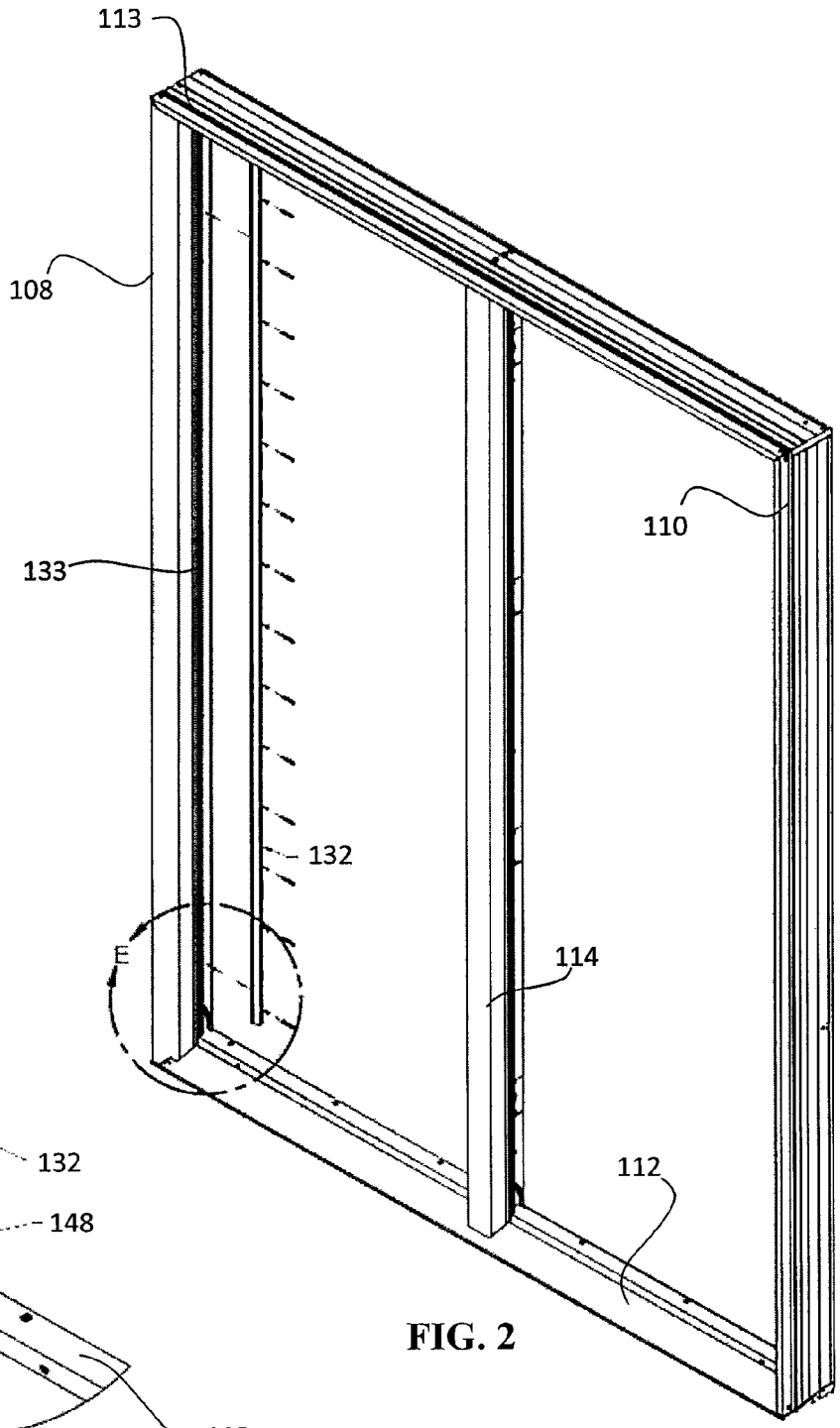
FIG. 2 is an alternate elevated view of the exterior side of the multi-panel door system of FIG. 1.
Figure 3:
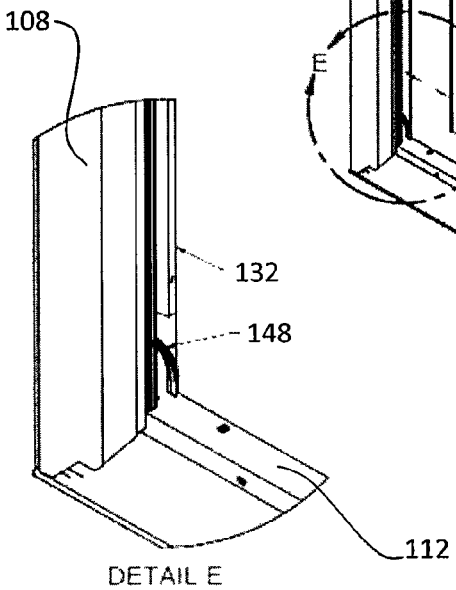
FIG. 3 is a partial cut-away view of the multi-panel door system of FIG. 2 cut along the circle E in FIG. 2.
Figure 4:
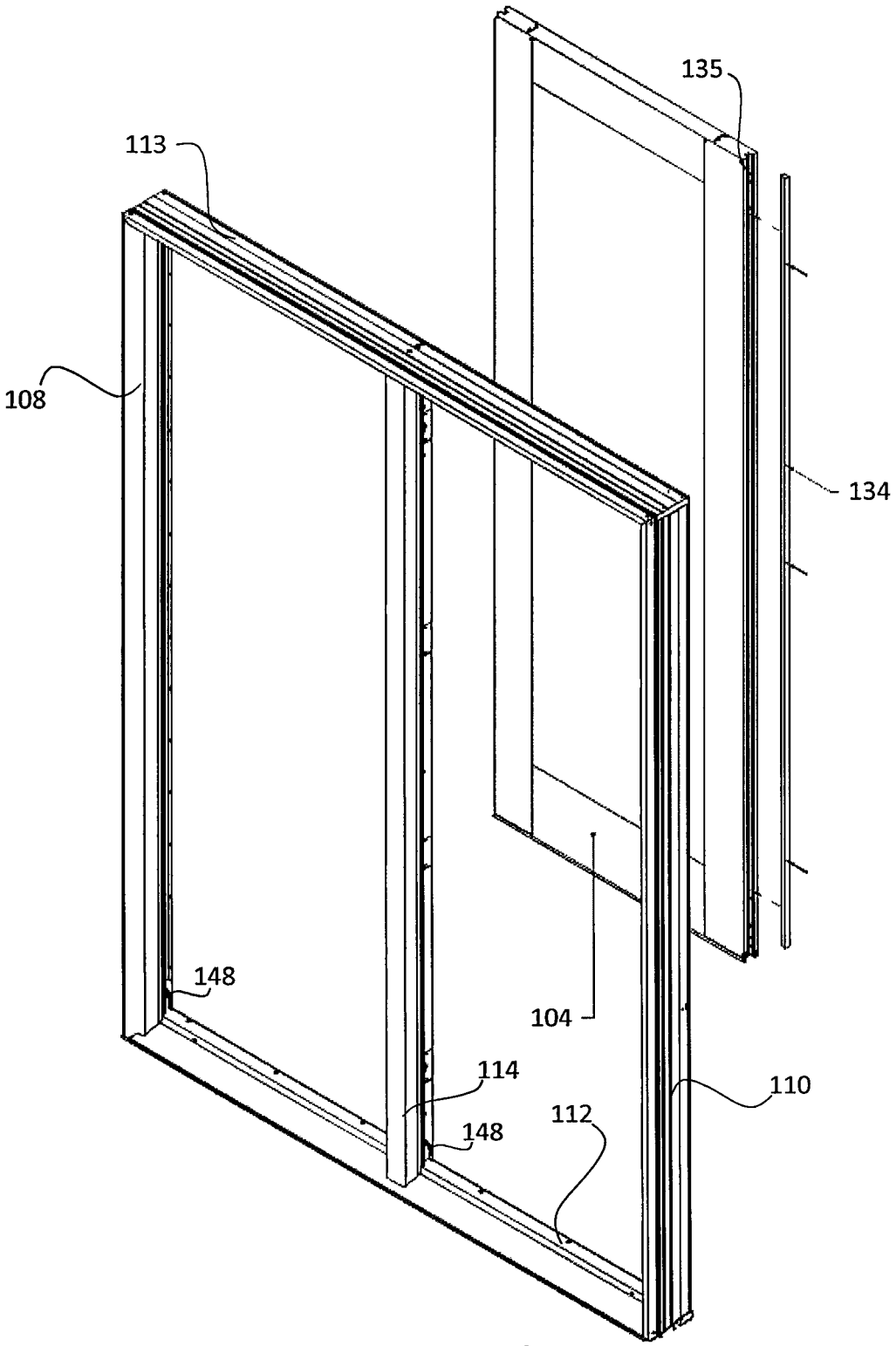
FIG. 4 is an exploded, elevated view of the exterior side of the multi-panel door system of FIG. 1 with the fixed panel in its preinstalled condition and the active panel omitted.

In order to align the first panel 104 and the second panel 106 within a single plane, in some embodiments the first panel 104 is placed between the first side jamb 108 and the astragal 114 where it is fixed in place using securement members 130, such as screws, nails, etc., driven through specific locations in the astragal 114. In particular, and as shown in FIGS. 2 and 3, a first filler stick 132 is attached to the first side jamb 108. The first filler stick 132 is also referred to as a first insert member 132. As shown in FIG. 4, a second filler stick 134 is attached to the side of the fixed panel 104 closest to the astragal 114. The second filler stick 134 is also referred to as a second insert member 134. In other embodiments, the first filler stick 132 is attached to the first panel 104 and/or the second filler stick 134 is attached to the astragal 114. In yet other embodiments, the insert members 132, 134 may be integrally formed with the door frame 102 and/or the first panel 104 or may be unitarily formed of a single material with the door frame 102 and/or the first panel 104.

Figure 5:
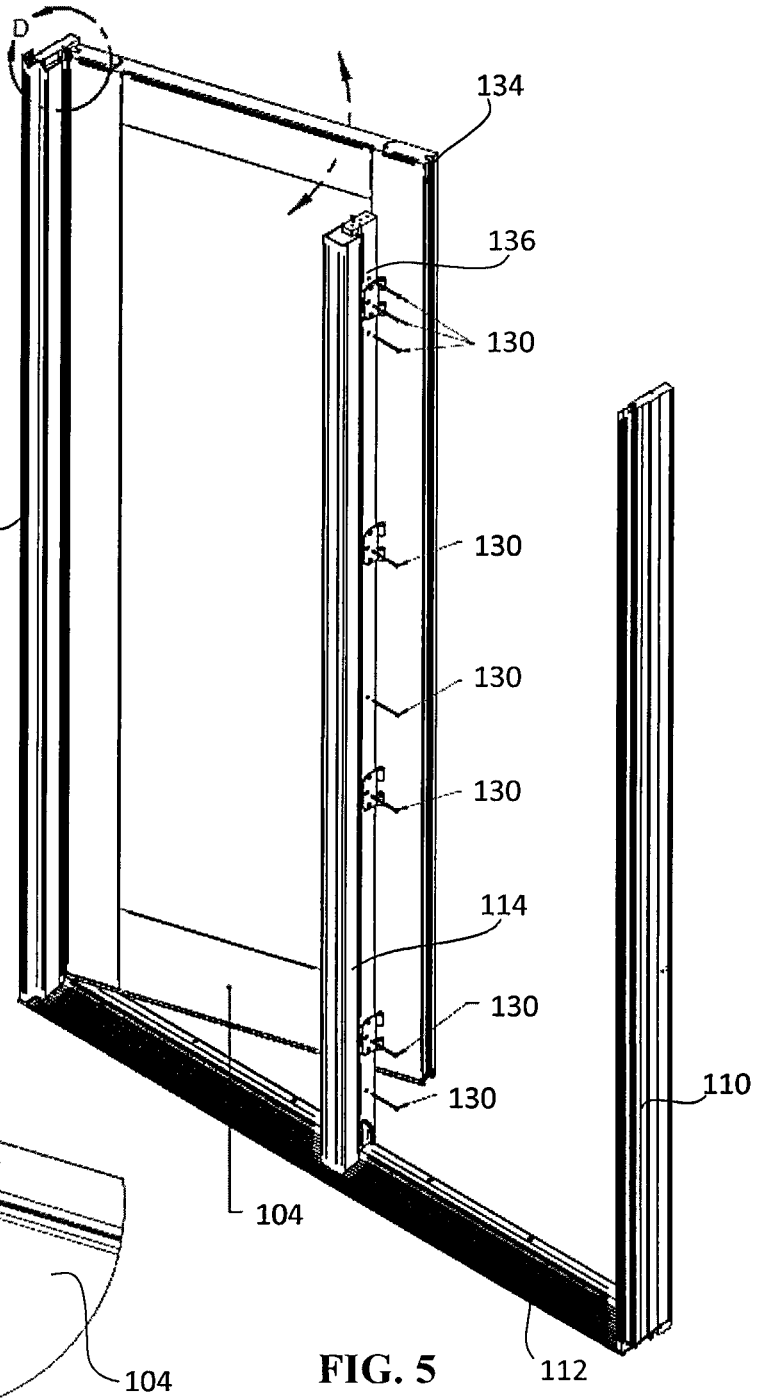
FIG. 5 is an elevated view of the exterior side of the multi-panel door system shown in FIG. 4, with the header omitted and with the fixed panel rotating into the door frame.
Figure 6:
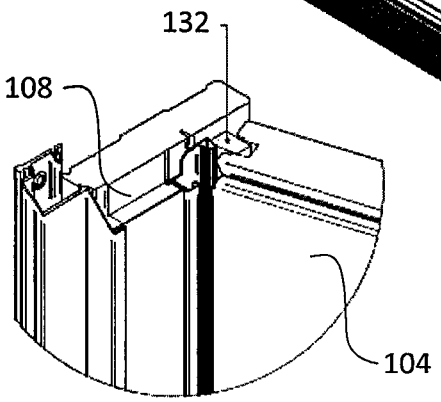
FIG. 6 is a partial cut-away view of the multi-panel door system of FIG. 5 cut along the circle D in FIG. 5.
Figure 7:
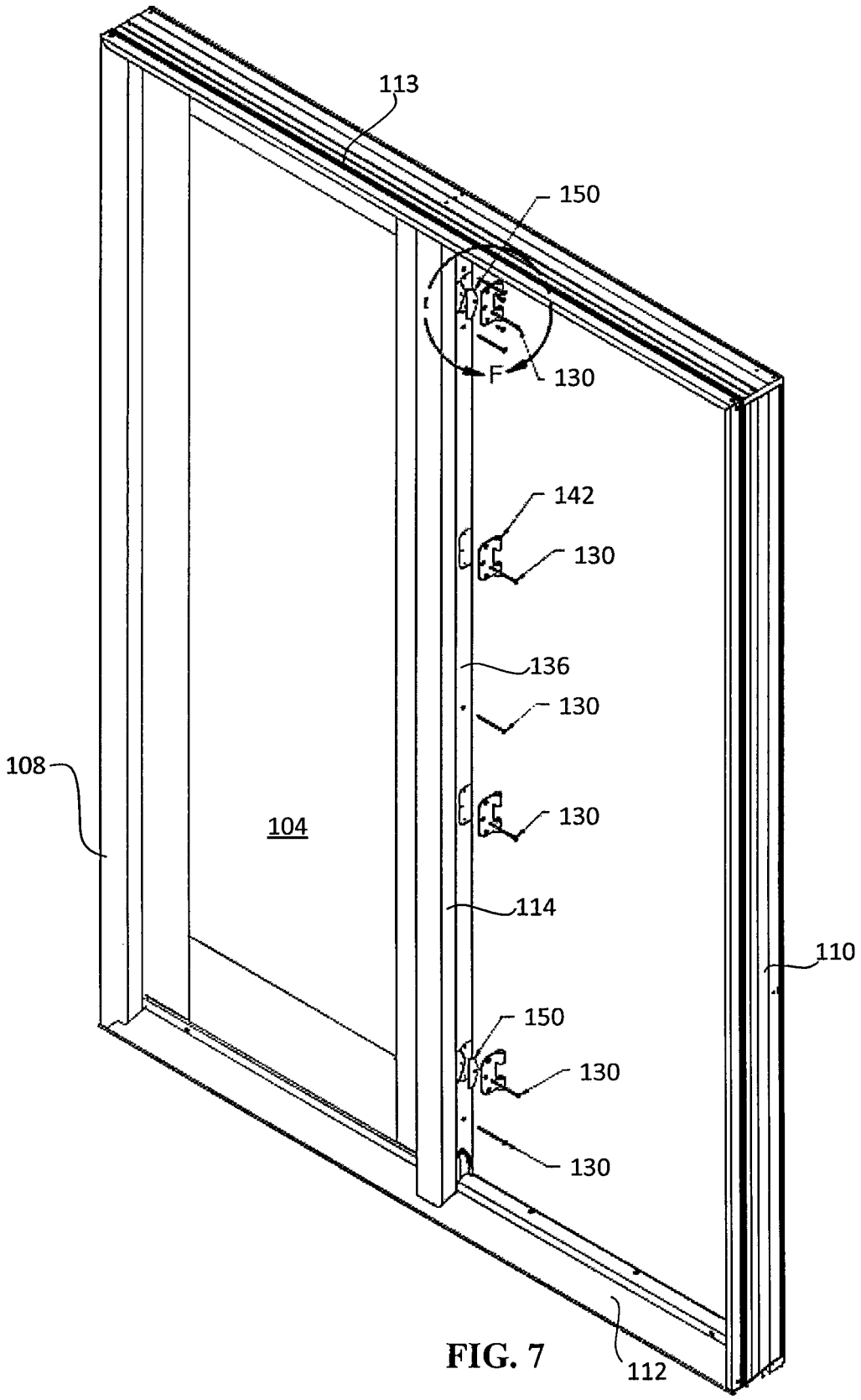
FIG. 7 is an elevated view of the exterior side of the multi-panel door system shown in FIG. 5, with the fixed panel in its installed position and depicting an exploded view of the hinge support brackets, the hinge leafs, and the securement members.

The first filler stick 132 acts as a pivot point so that the fixed panel 104 rotates into position between the first side jamb 108 and the astragal 114, as shown in FIGS. 5 and 6. As discussed below in more detail, the first filler stick 132 also serves as a pivot point during the removal of the first panel 104 from the door frame 102. By using the filler sticks 132, 134, the multi-panel door system 100 can secure the first panel 104 to the door frame 102 without the need for screws or other securement members through the side jambs 108, 110, the sill 112, and/or the head 113. The filler sticks 132, 134 also assist in spacing the first panel 104 between the first side jamb 108 and the astragal 114. In other embodiments, the fixed panel 104 can be placed directly between the first side jamb 108 and the astragal 114, i.e., without the use of filler sticks 132, 134. In those embodiments, hinges or other hardware may be used to pivotally connect the fixed panel 104 to the first side jamb 108.

In some embodiments, the first insert member 132 is placed within a rout 133 in the first side jamb 108 and/or fits within a rout in the fixed panel 104 when the fixed panel 104 is rotated into the door frame 102. Similarly, the second insert member 134 may be placed within a rout 135 in the fixed panel 104 and/or within a rout in the astragal 114 when the fixed panel 104 is rotated into the door frame 102. In this manner, the insert members 132, 134 form tongue-in-groove joints that add stability to the multi-panel door system 100, particularly in directions perpendicular to the outer surface 124 of the fixed panel 104. At the same time, the insert members 132, 134 facilitate the removal of the fixed panel 104 because the securement of the fixed panel 104 does not require additional securement members driven into the side jamb 108, sill 112, or header 113 of the door frame 102. At the same time, in some embodiments, additional securement members, such as staples, may be used to supply supplemental securing forces in a manner that does not substantially hinder panel removal. In some embodiments, the second panel 106 and/or the second side jamb 110 have routs, similar to the routs 133, 135, that are used to mount locking hardware or other components. In those embodiments, the arrangement of routs creates panels 104, 106 having similar or identical grooved patterns.

As further shown in FIG. 5, as well as in FIGS. 7-10, once the first panel 104 is placed between the side jamb 108 and the astragal 114, securement members 130, such as screws, are driven into the opposite side 134 of the astragal 114, through the astragal 114, and into the first panel 104. In particular, the securement members 130 are driven into and through a mid-section of the astragal 114, specifically, the middle portion 136 of the astragal stem 160, discussed below in more detail. This enables the multi-panel door system 100 to secure the first panel 104 in a recessed position with respect to the door frame 102 without using separate fixed stops, which can be detrimental to the overall aesthetics of the multi-panel door system 100. In addition, securing the fixed panel 104 using securement members 130 driven through the middle portion 136 of the astragal stem 160 enables users to easily replace the fixed panel 104 by accessing those securement members 130 from the opposite side of the astragal 114, rather than needing to remove screws or other securement members driven through other portions of the door frame 102 and into the fixed panel 104.

Figure 8:
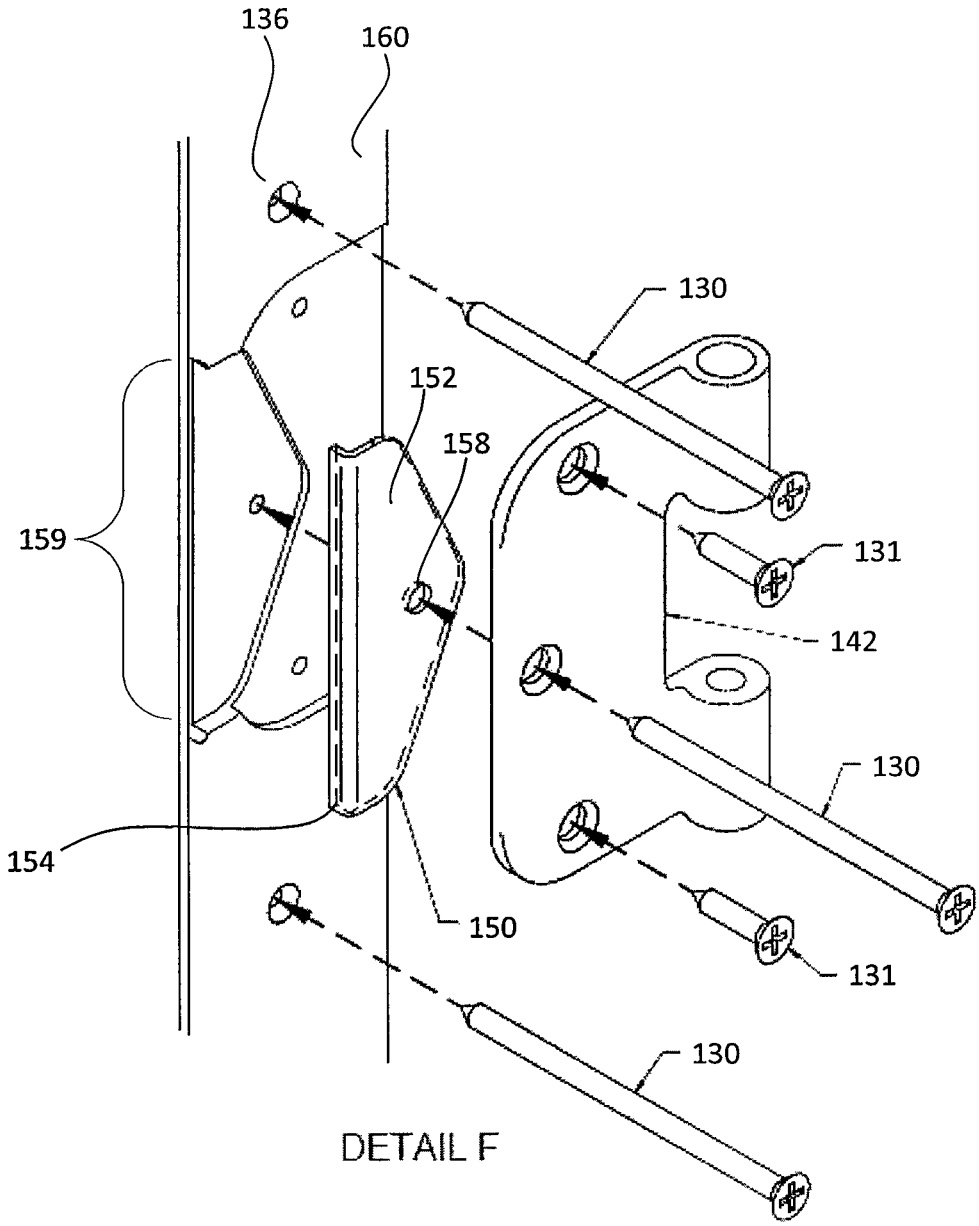
FIG. 8 is a partial cut-away view of the multi-panel door system of FIG. 7 cut along the circle F in FIG. 7, with the hinge support plate, hinge leaf, and securement members shown in an exploded view.
Figure 9A:
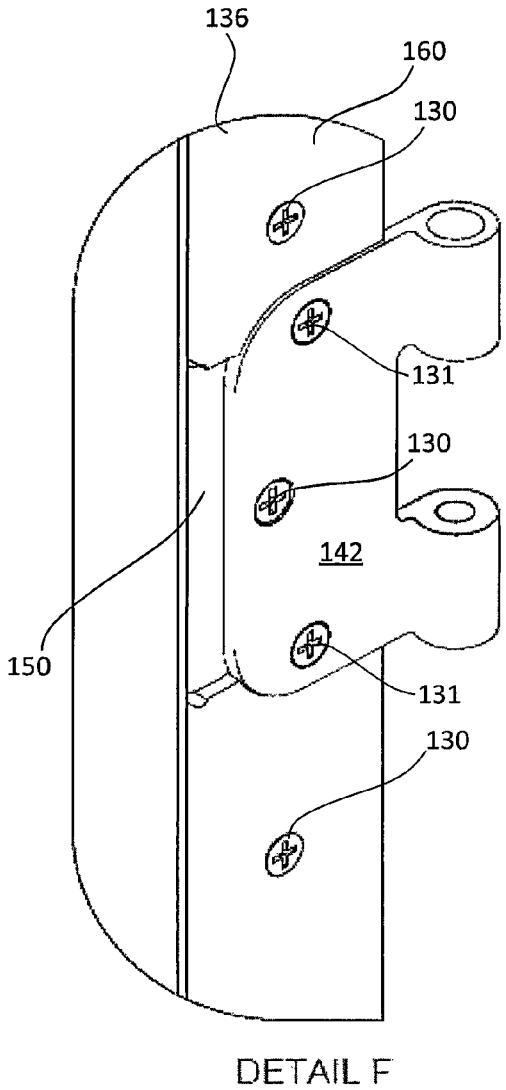
FIG. 9A is the partial cut-away view of FIG. 8 illustrating the hinge support plate, hinge leaf, and securement members in their installed positions.
Figure 9B:
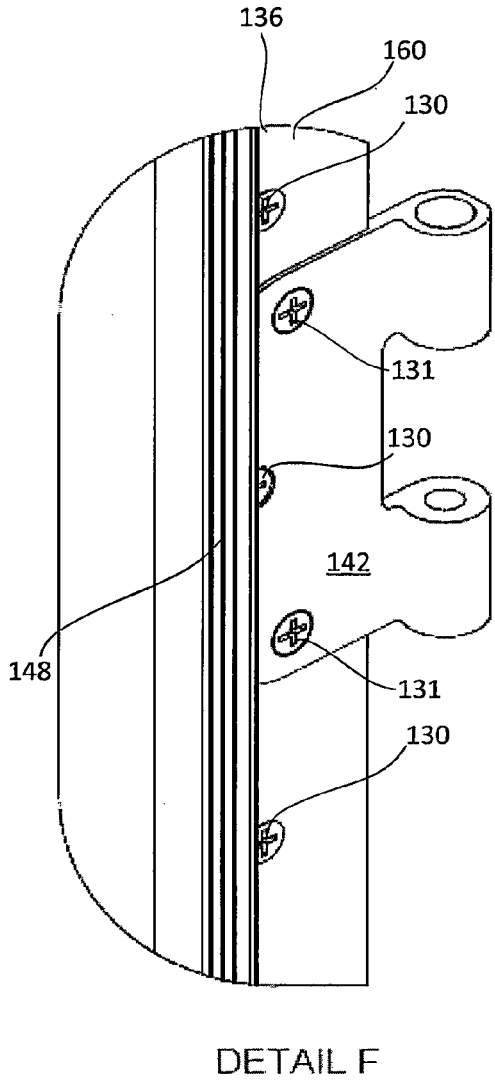
FIG. 9B is the partial cut-away view of FIG. 9A further illustrating a seal placed over the hinge plate.
Figure 10:
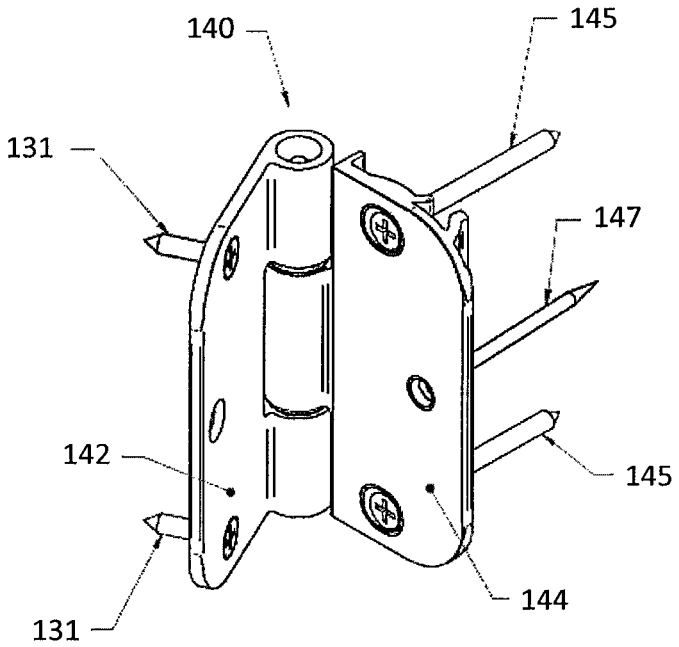
FIG. 10 is an elevated view of a hinge in combination with various securement members, in accordance with embodiments of the present invention.
Figures 11, 12:
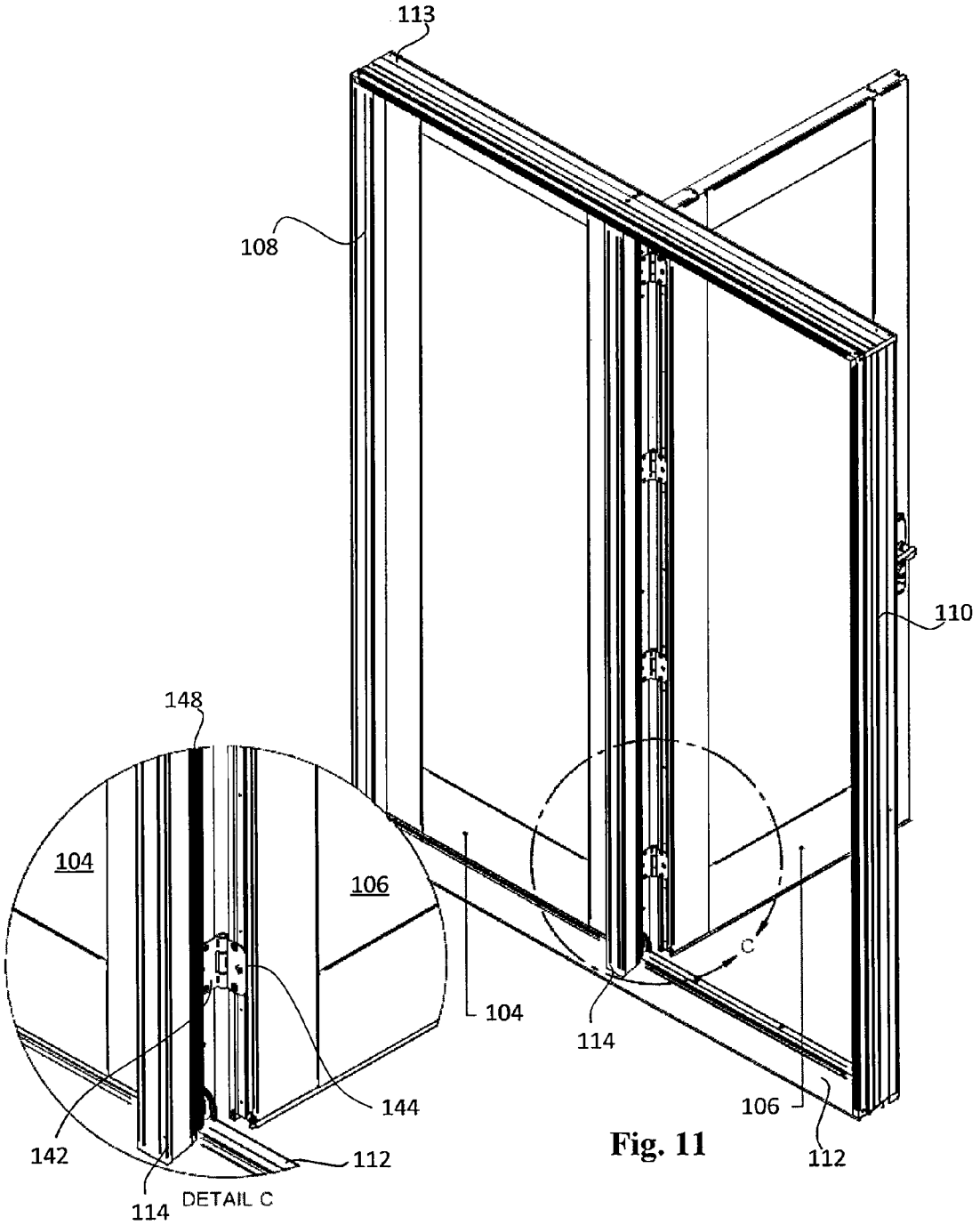
FIG. 11 is an elevated view of the exterior side of the multi-panel door system shown in FIG. 1, illustrating the hinged coupling between the active panel and the astragal assembly.
FIG. 12 is a partial cut-away view of the multi-panel door system of FIG. 11 cut along the circle C in FIG. 11.
Figure 13:
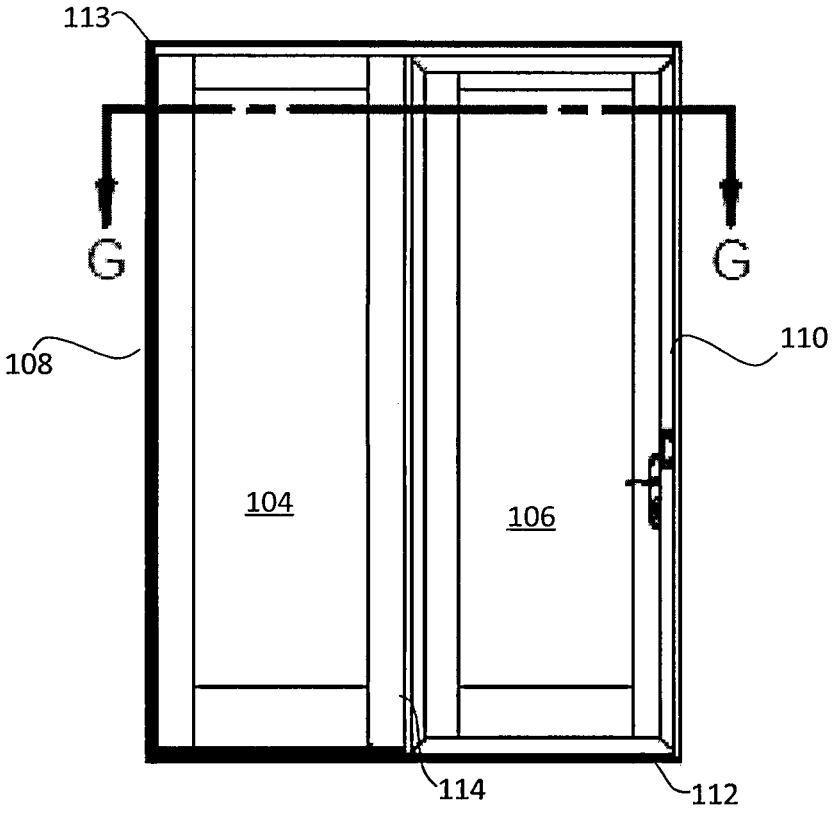
FIG. 13 is a front view of the multi-panel door system of FIG. 1, including a screen assembly.

In some embodiments, and as further shown in several of the figures, such as FIG. 11, the second panel 106 is an active panel 106 pivotally connected to the astragal 114 through hinges 140. Specifically, each hinge 140 includes hinge leafs 142 and 144. Hinge leaf 142 is secured to the astragal using the securement members 130, which also secure the first panel 104 to the astragal 114. Additional securement members 131, for example, the smaller screws 131 shown in FIG. 8, provide additional securing forces to fix the hinge leaf 142 to the astragal 114. Similarly, as shown in FIG. 10, securement members 145, for example screws 145 that are longer than the smaller screws 131 but shorter than the securement members 130, are used to secure the hinge leaf 144 to the active panel 106. A panel adjustment screw 147 may also be placed through the hinge leaf 144 and into the active panel 106 and can be used to adjust the position of the active panel 106 with respect to the hinge leaf 144.

Thus, the securement members 130 align the first panel 104 and the active panel 106. As a result, the outer surface 126 of the active panel 106 is coplanar with the outer surface 124 of the first panel 104 (i.e., within the outer panel plane 128) when the active panel 106 is in a closed position. The hinges 140 enable the active panel 106 to pivot into an open position, in which the outer surface 126 of the vent panel 106 is no longer coplanar with the outer surface 124 of the first panel 104 (i.e., the outer surface 126 lies within a plane forming an angle with the outer panel plane 128). Spacers may also be placed between the door frame 102 and the panels 104, 106 in order to create a more uniform spacing.

The multi-panel system 100 shown in FIG. 1 enables the easy replacement of the first panel 104. Rotating the active panel 106 to an open position will expose the securement members 130 that secure the first panel 104 to the door frame 102. Once those screws are removed, the first panel 104 can rotate about the pivot point created by the first filler stick 132. In some embodiments, the first panel 104 rotates about 45 degrees from the frame 102. The first panel 104 may then be pulled free of the door frame 102. In some embodiments, staples extend from the first side jamb 108 to provide additional securing forces to the first panel 104. By rotating the first panel 104 away from the door frame 102, the first panel 104 can be pulled out to release it from the staples. In other embodiments, no staples or any additional securement member are used to supplement the securing forces of the securement members 130.

In some embodiments, and as shown in several figures, such as FIGS. 4 and 12, the multi-panel door system 100 includes seals 148 placed between the panels 104, 106 and the door frame 102. Exemplary seals 148 include the weather seals described in U.S. Pat. No. 8,393,115 and U.S. patent application Ser. No. 13/763,250. The content of both U.S. Pat. No. 8,393,115 and U.S. patent application Ser. No. 13/763,250 are incorporated herein by reference in their entireties.

Figure 15:
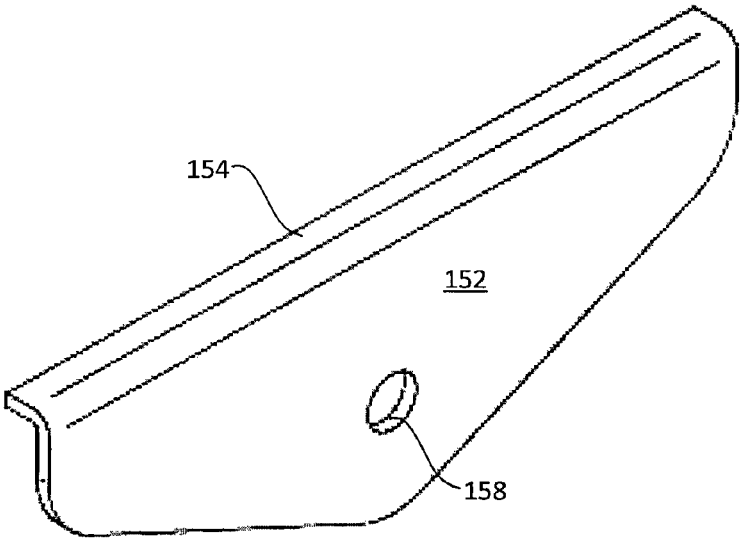
FIG. 15 is an elevated view of a hinge support plate, according to embodiments of the present invention.
Figure 16:
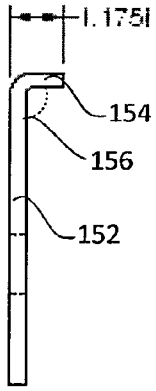
FIG. 16 is a side view of the hinge support plate of FIG. 15.
Figure 17:
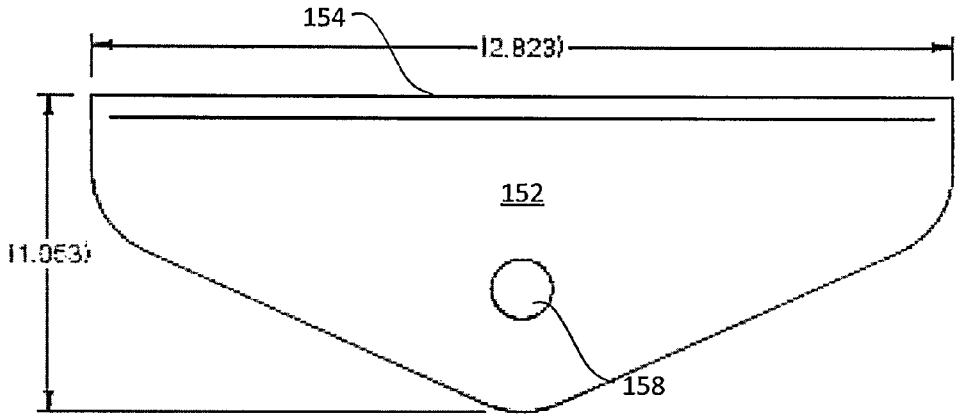
FIG. 17 is a front view of the hinge support plate of FIG. 15.
Figure 18:
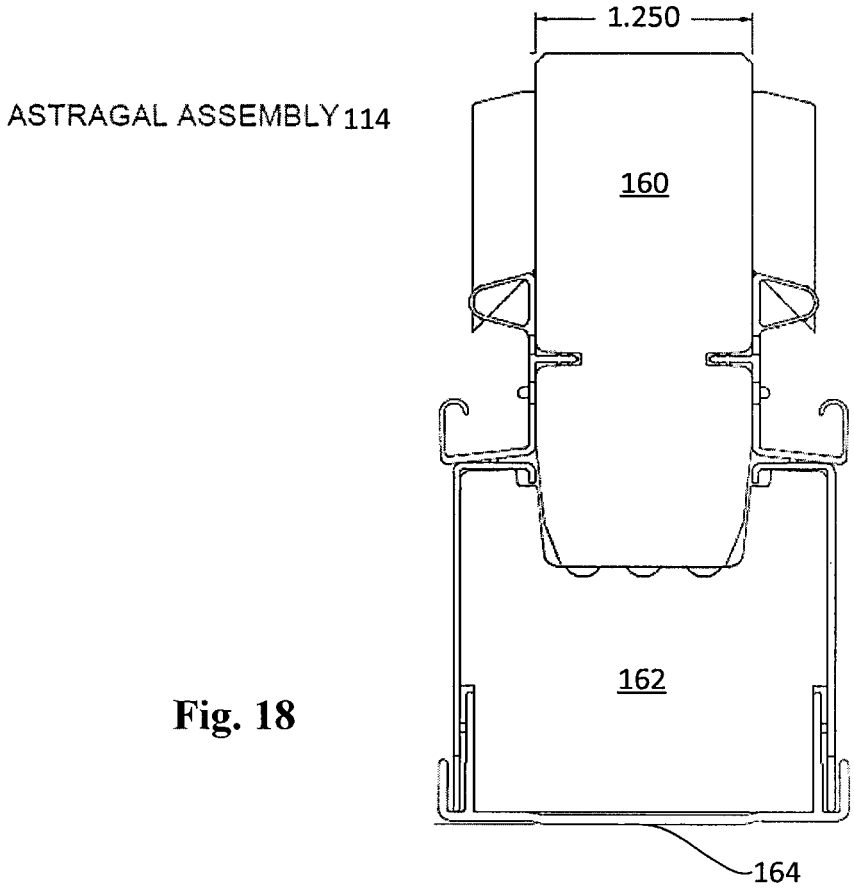
FIG. 18 is a top view of an astragal assembly, according to embodiments of the present invention.

Securing the panels 104, 106 to the astragal 114 using securement members 130 driven through the middle portion 136 of the astragal stem 160 enables an aesthetically pleasing design and increased access for panel replacement. However, forces on the multi-panel door system 100 (e.g., forces from operation of the active panel, impact of external objects, wind loads, etc.), might place undesired levels of stress on particular sections of the astragal 114. To address that issue, in some embodiments the door assembly 100 includes hinge support brackets 150 that disperse forces transmitted through the securement members 130 into a larger portion of the astragal 114. Specifically, hinge support bracket 150 includes a first portion 152 and a second portion 154 that forms an angle 156 with the first portion 152. For example, in the hinge support bracket 150 shown in FIGS. 15-17, the second portion 154 forms a 90-degree angle 156 with the first portion 152. As one of skill in the art will appreciate, that angle may vary, for example, from 30 to 110 degrees. The second portion 154, in some embodiments, extends deeper into the astragal stem 160, described below in more detail. The first portion 152 of the hinge support bracket 150 includes an aperture 158 that receives a securement member 130 as it is driven into the astragal 114.

As shown in FIG. 8, the first portion 152 is placed between the astragal 114 and the hinge 140. The second portion 154 is placed within a rout 159 within the astragal 114 in order to transmit forces from the first portion 152 (e.g., forces transmitted through a securement member 130) into a deeper or larger portion of the astragal 114. The hinge support bracket 150 may be partially or completely hidden underneath the hinge leaf 142 and/or other elements, such as weather seals 148 placed between the second panel 106 and the astragal 114.

Figure 14:
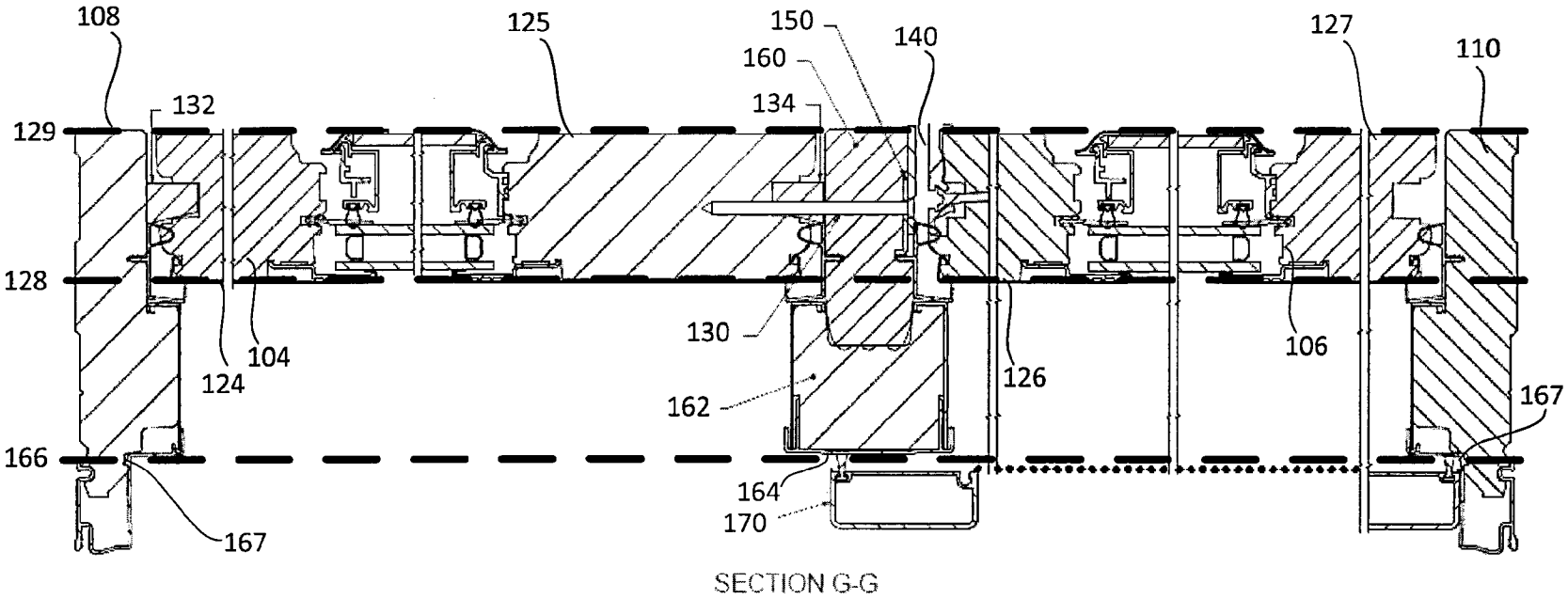
FIG. 14 is a partial cut-away view of the multi-panel door system of FIG. 13 cut along the line G-G in FIG. 13.
Figure 19:
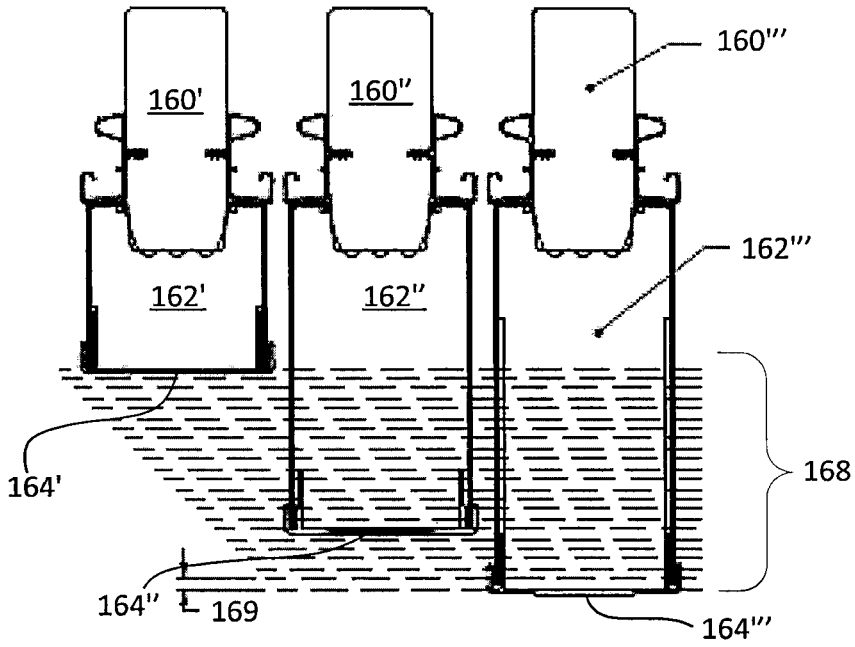
FIG. 19 is a comparative top view of three astragal assemblies, in accordance with embodiments of the present invention.
Figure 20:
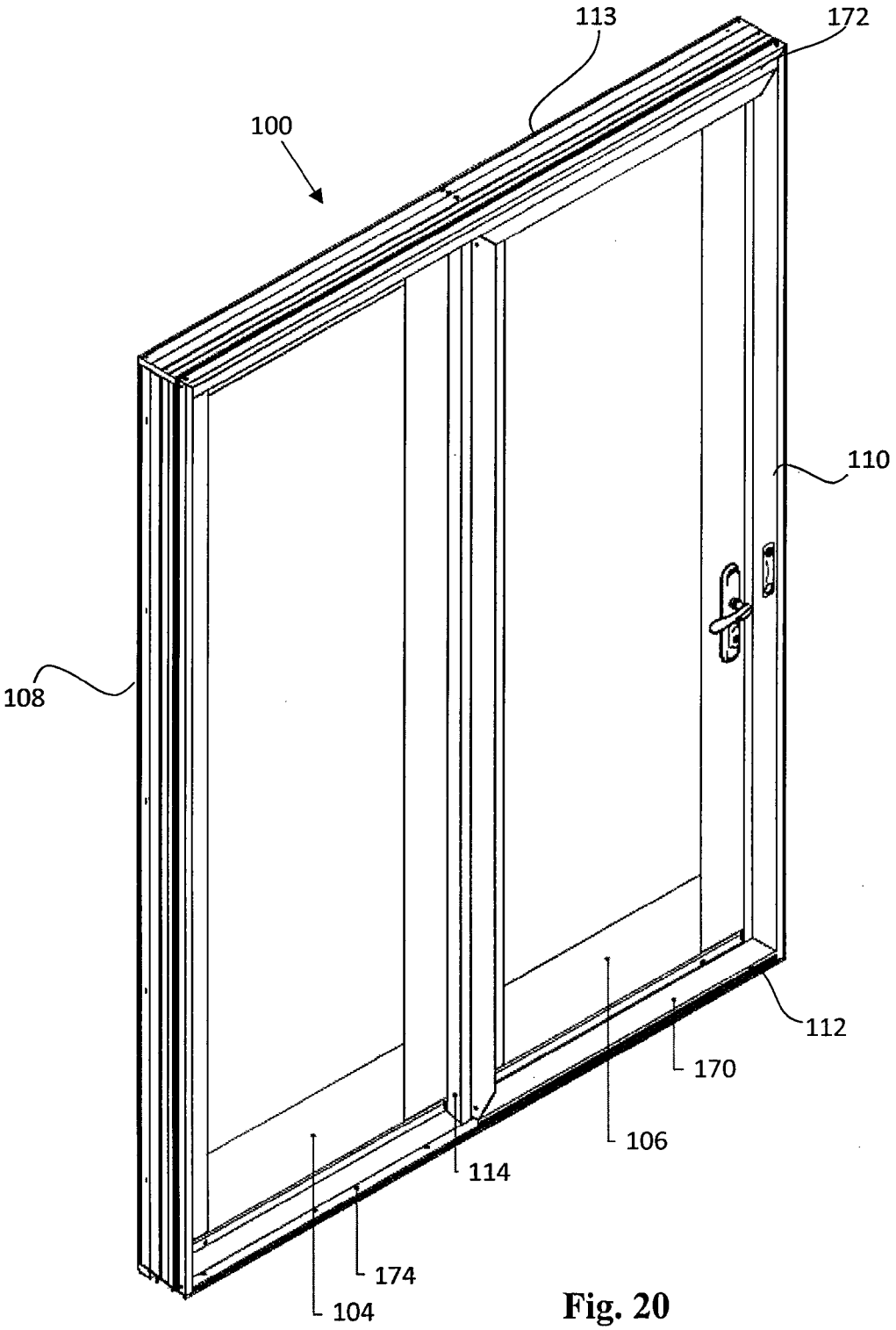
FIG. 20 is an elevated view of the exterior side of the multi-panel door system shown in FIG. 13.
Figure 21:
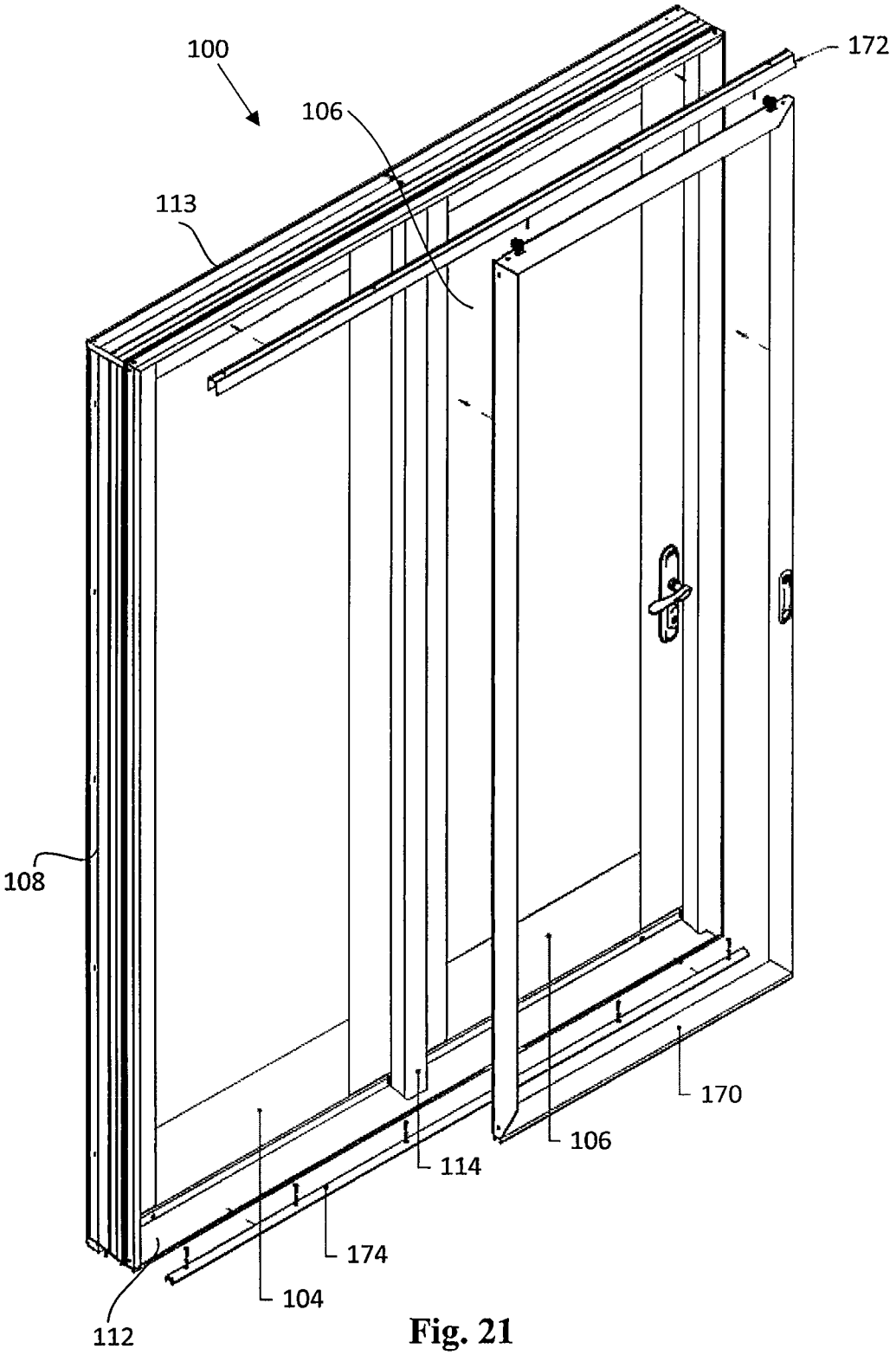
FIG. 21 is an elevated view of the exterior side of the multi-panel door system shown in FIG. 20, with the screen assembly shown in an exploded view.
Figure 22:
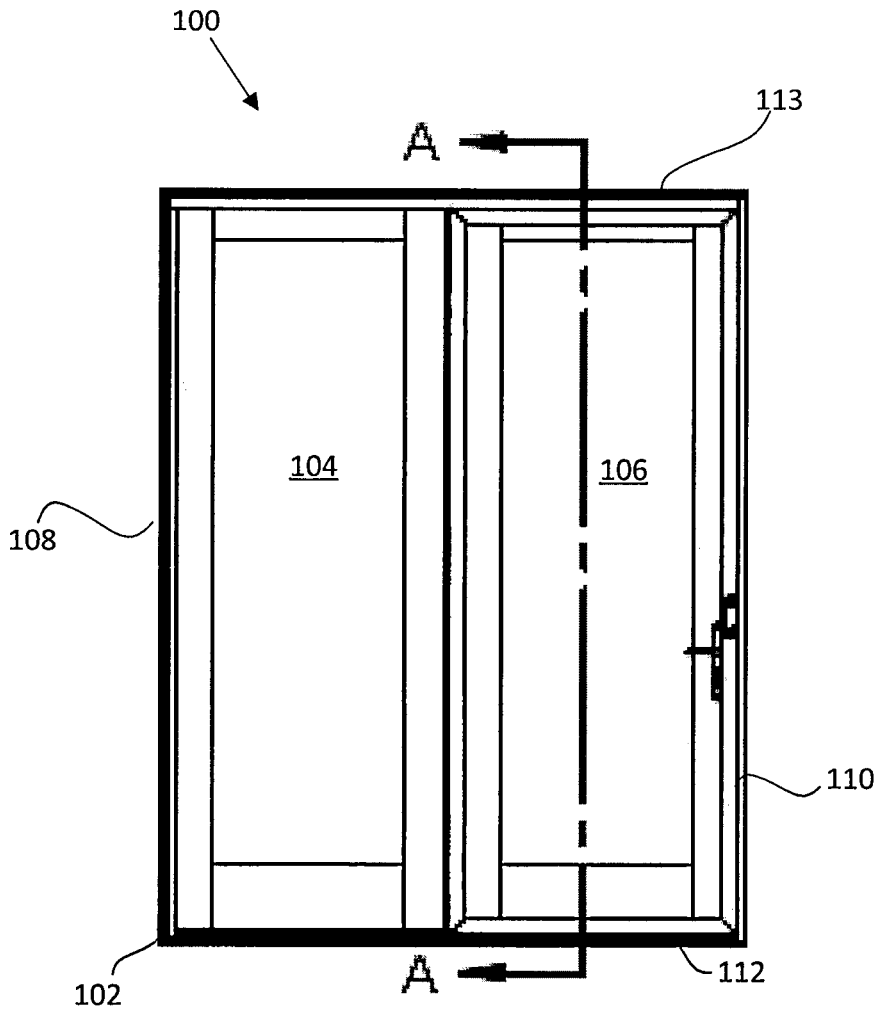
FIG. 22 is a front view of the multi-panel door system shown in FIG. 20.
Figure 23:
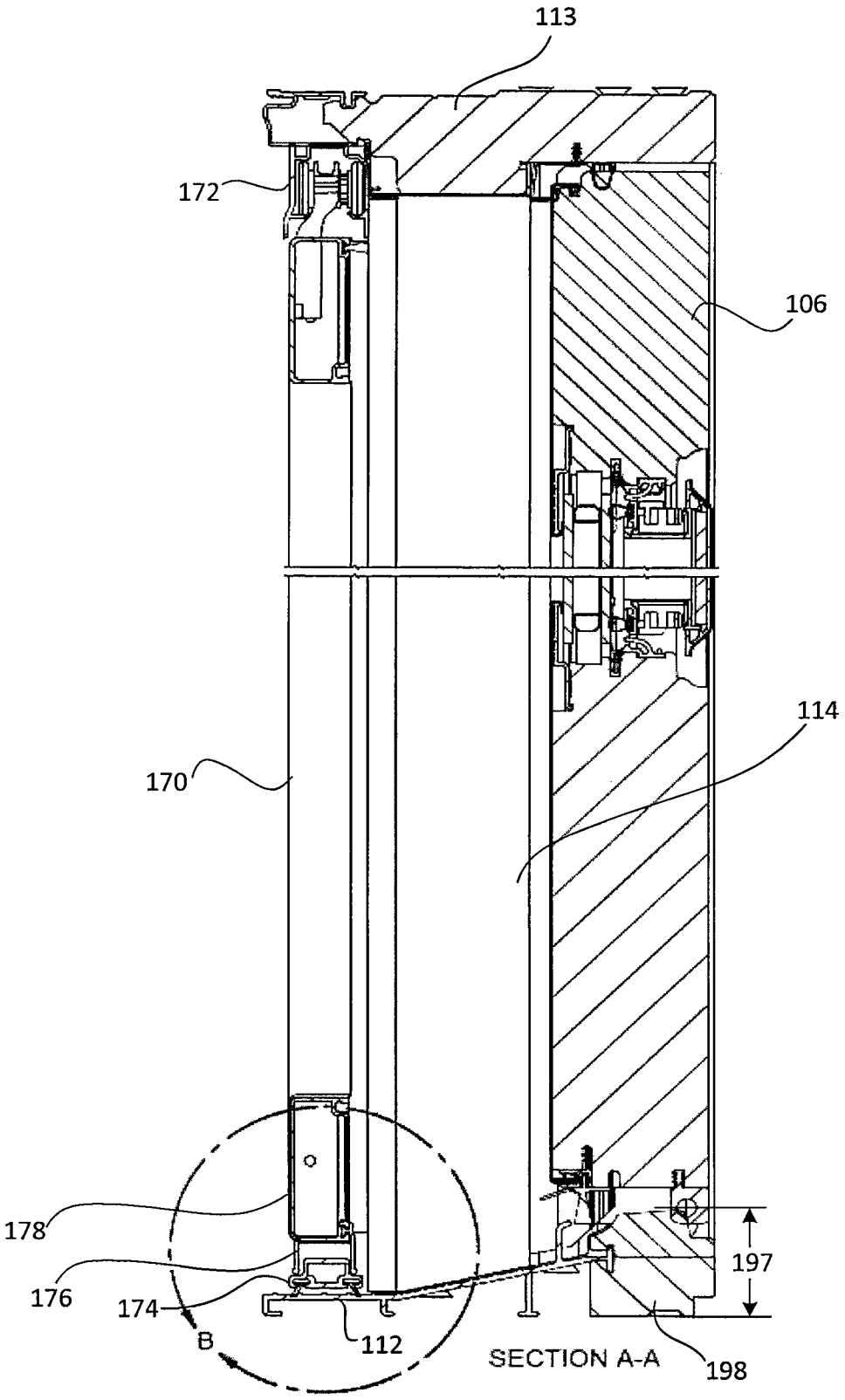
FIG. 23 is a partial cut-away view of the multi-panel door system of FIG. 22 cut along the lines A-A in FIG. 22.
Figure 24:
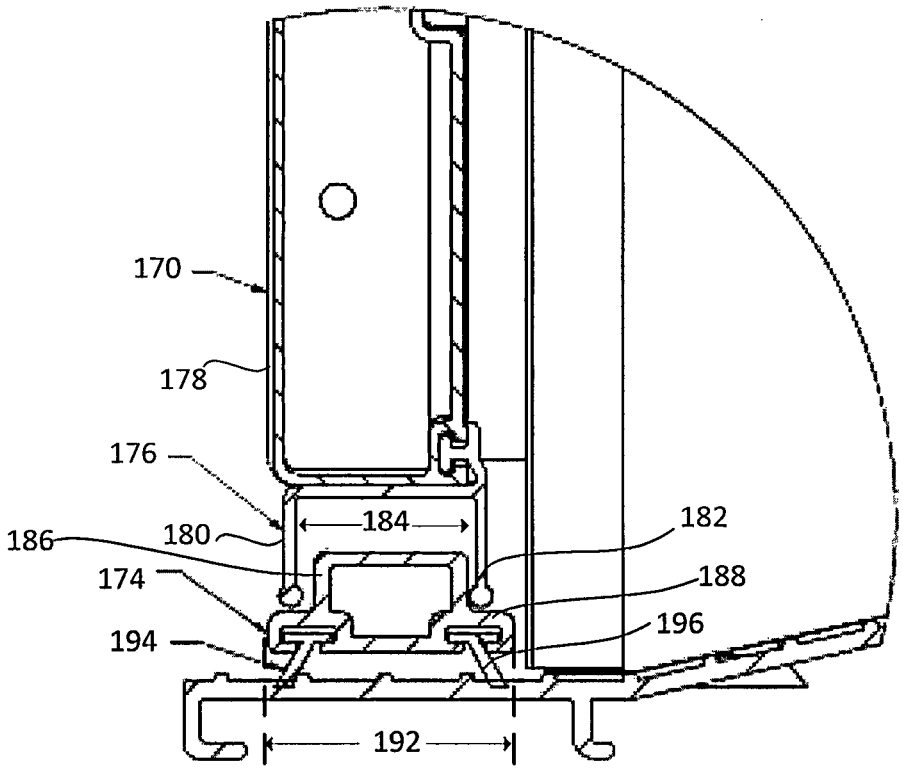
FIG. 24 is a partial cut-away view of the multi-panel door system of FIG. 23 cut along the circle B in FIG. 23.
Figure 25:
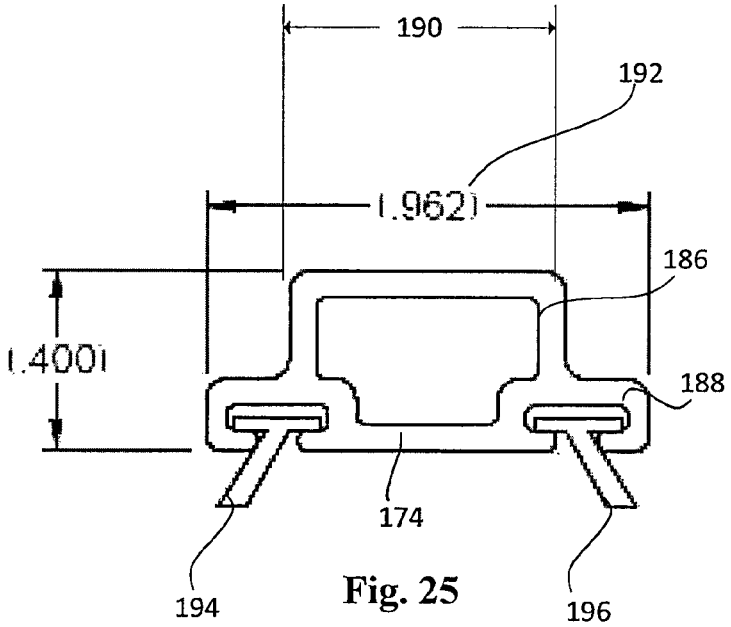
FIG. 25 is a side view of a sill screen track, in accordance with embodiments of the present invention.
Figure 26:
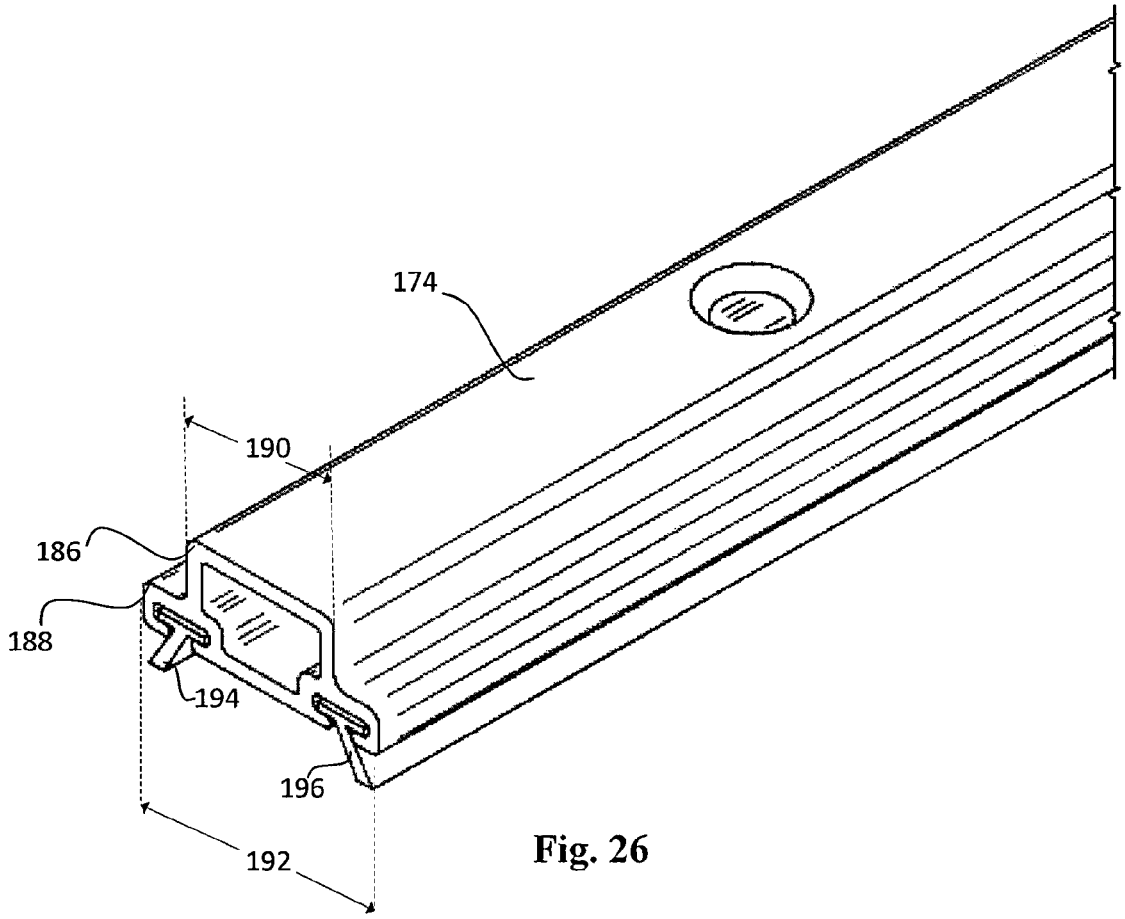
FIG. 26 is an elevated view of the sill screen track of FIG. 25.
Figure 27:
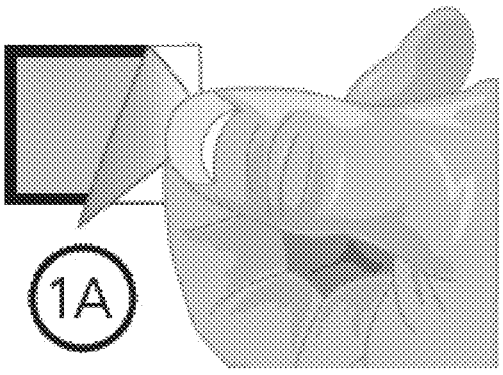
FIG. 27 illustrates the removal of a protective backing on a spacing member, in accordance with embodiments of the present invention.
Figure 28:
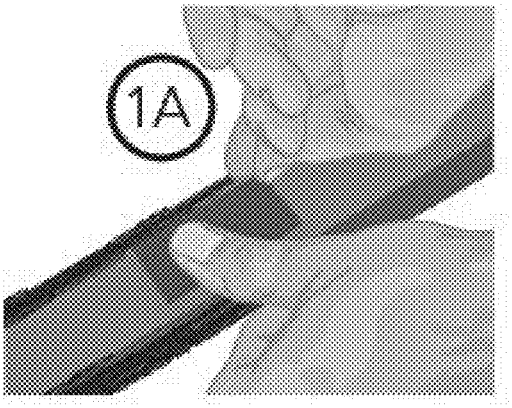
FIG. 28 illustrates the fixation of the spacing member of FIG. 27 to a sill screen track, in accordance with embodiments of the present invention.
Figure 29:
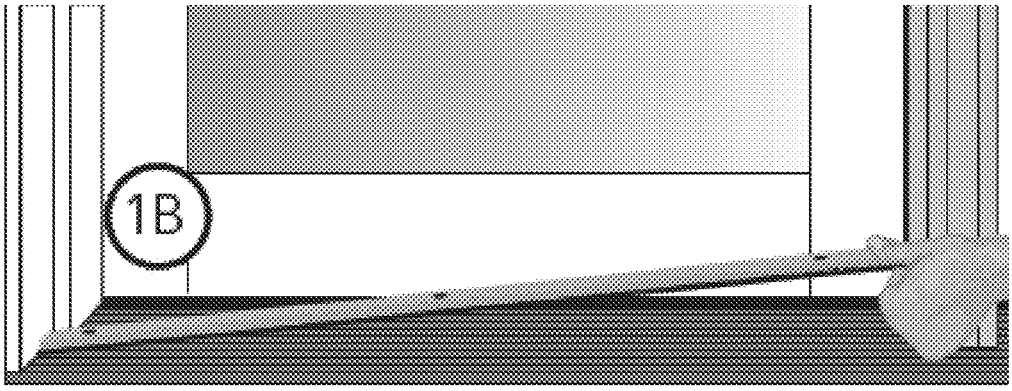
FIG. 29 illustrates the placement of the sill screen track of FIG. 27 to a sill of a door frame, in accordance with embodiments of the present invention.
Figure 30:
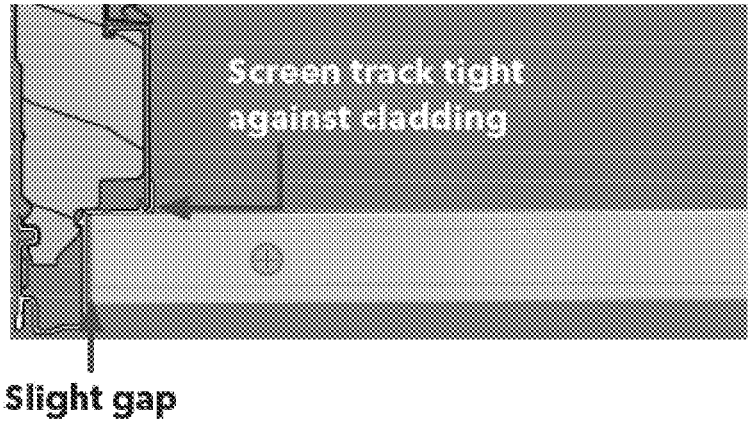
FIG. 30 is a cut-away top view of the sill screen track of FIG. 27 and a door frame, in accordance with embodiments of the present invention.
Figure 31:
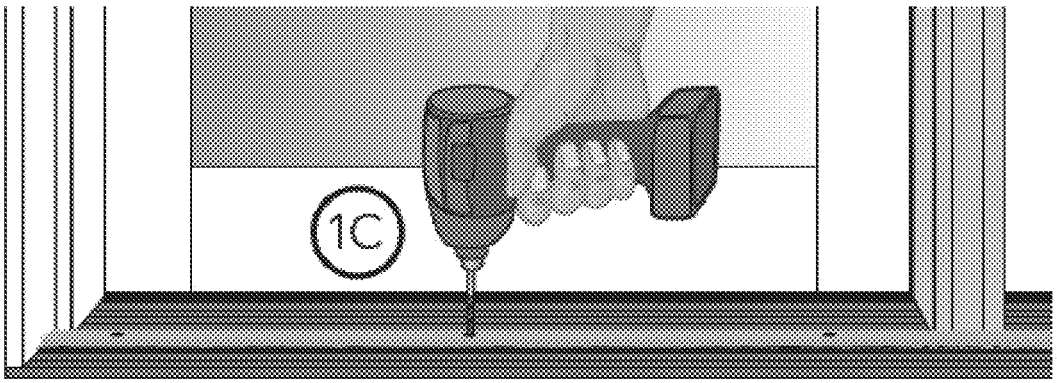
FIGS. 31-32 illustrate the installation of the sill screen track of FIG. 27, in accordance with embodiments of the present invention.
Figure 32:
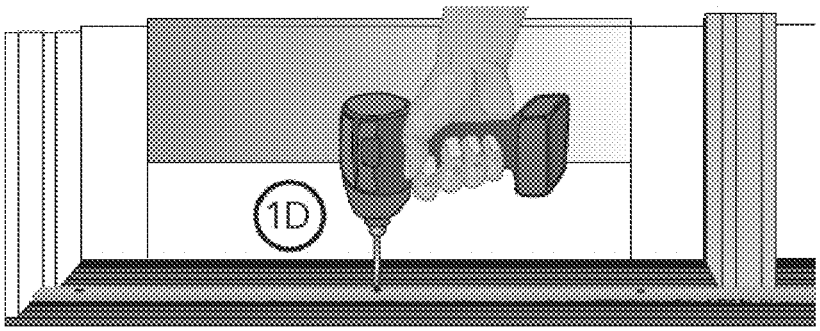
Figure 33:
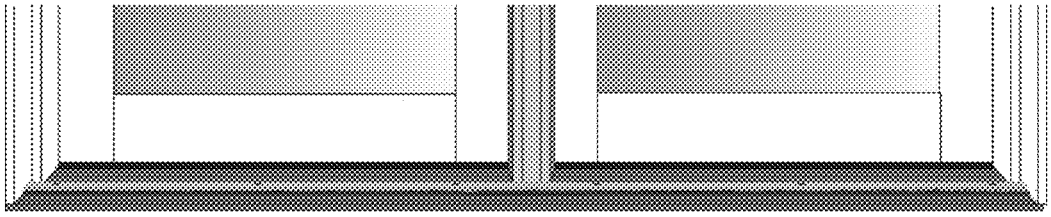
FIG. 33 illustrates an installed sill screen track as it spans a distance in front of two panels of a multi-panel door system, in accordance with embodiments of the present invention.

In some embodiments, the astragal 114, also referred to as the astragal assembly 114, is formed by two components: a stem 160 and a cap 162, also referred to as the astragal stem 160 and the astragal cap 162, respectively. The stem 160 and the cap 162 may be formed of two distinct materials. In particular, the stem 160 may be formed of a material selected for its strength, durability, cost, and/or aesthetic appeal. The cap 162 may also be selected of a different material for its strength, durability, cost, and/or aesthetic appeal. For example, interior facing stem 160 may be formed of a more expensive wood, such as mahogany, while the cap 162 may be formed of a less expensive wood to reduce the overall cost of the door system 100. In addition, the cap 162 may be cut to a specific size so that the exterior surface 164 aligns with a screen plane 166, whose position depends on the depth of the door frame 102 (e.g., the depth of the first side jamb 108 and/or the second side jamb 110). In particular, and as shown in FIG. 14, the screen plane 166 extends from frame clads 167 on the side jambs 108, 110 and aligns with the exterior surface 164. As a result, a constant screen seal can be created along the screen plane 166. The caps 162 may be pre-manufactured in a variety of sizes, so that a particular cap 162 may be selected and implemented for a particular door frame 102. In FIG. 19, stems 160', 160", 160''' are shown with corresponding caps 162', 162", 162''' of various depths. In some embodiments, the caps 162 are sized within a range 168 from 7 & 5/16 inches to 4 & 9/16 inches, in increments of 1/8 inch (as shown by 169), in order to align the exterior surface 164 with a screen plane 166 in door systems 100 of various depths. In other embodiments, a larger range 168 and/or smaller increments are used.

As shown in several of the figures, in particular FIGS. 20-24, in some embodiments the multi-panel door system 100 includes a screen 170, such as a sliding screen. The screen 170 is attached to a head screen track 172, which is fixed to the head 113 of the door frame 102. Attached to the sill 112 is a sill screen track 174. As described below in more detail, the sill screen track 174 is spaced above the sill 112 to allow water to pass underneath the sill screen track 174. For example, spacers may be placed between the sill screen track 174 and the sill 112 to create that spacing.

As best shown in FIGS. 23-26, the screen 170 includes a screen guide 176 coupled to a screen bottom rail 178 of the screen 170. The screen guide 176 includes an exterior extension 180 and an interior extension 182, which are approximately parallel and separated by a width 184. The sill screen track 174 includes an upper portion 186 and a lower portion 188. The upper portion has a width 190 less than the width 184 separating the exterior extension 180 and an interior extension 182, so that the upper portion 186 lies between the exterior extension 180 and the interior extension 182. The lower portion 188 has a width 192 that is larger than the width 184 separating the exterior extension 180 and an interior extension 182, so that the exterior extension 180 and the interior extension 182 are directly above the lower portion 188. Coupled to the lower portion 188 are exterior bristles 194 and interior bristles 196. These bristles 194, 196 allow water that has passed through the screen 170 to egress underneath the sill screen track 174. At the same time, the bristles 194, 196 prevent the ingress of insects and other undesired objects.

One advantage of the sill screen track 174 is that it enables a smaller sill profile while still enabling the egress of water. For example, in some embodiments the height 197 of the sill assembly 198 is less than two inches, in particular, approximately 1.5 inches. Other systems, in contrast, use a series of apertures, which requires a sill block with a higher profile, e.g., two inches or more, so that pressure from water buildup behind the screen track pushes moisture through the apertures. The higher profile creates a more hazardous construction as users are more prone to trip as they pass over the sill 112 or the threshold of the door.

According to various embodiments, the multi-panel door system 100 includes more than two (e.g., 3, 4, or more) panels. For each panel, the stops that fix the panel to the frame are hidden between the side or sides of the panel and the jambs and/or astragal(s) of the frame. The hinge support plates are also hidden from view (e.g., by the hinge plate and the seals) and do not require additional steps to install or activate once the multi-panel door system is installed.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A multi-panel door system in which the panels are aligned within a plane, the multi-panel door system comprising:

a door frame including a first doorjamb, a second doorjamb, a sill, and an astragal located between the first door jamb and the second doorjamb, the door frame forming an exterior facing surface and an interior facing surface;

a fixed panel placed between the first door jamb and the astragal, the fixed panel being secured to the astragal by one or more securement members each driven through a middle section of the astragal and into the fixed panel, the fixed panel being secured between the exterior facing surface of the door frame and the interior facing surface of the doorframe without using visible fixed stops; and a vent panel placed between the second door jamb and the astragal, the vent panel being pivotally secured to the astragal through one or more hinges that are fixed to the middle section of the astragal by at least one of the one or more securement members.

2. The multi-panel door system of claim 1, further comprising one or more hinge support plates adapted to spread the force exerted by the one or more securement members on the middle section of the astragal into a deeper portion of the astragal.

3. The multi-panel door system of claim 2, wherein each of the one or more hinge support plates includes a first face adapted to receive at least one of the one more securement members and a second face that forms an angle with the first face.

4. The multi-panel door system of claim 3, wherein the astragal includes one or more grooves adapted to receive one or more of the second faces of the one or more hinge support plates.

5. The multi-panel door system of claim 1, wherein the astragal includes an astragal stem formed of a first material and an astragal cap that is formed of a second material different than the first material, the astragal stem includes the middle section through which the one or more securement members are driven, and the astragal stem and the astragal cap jointly form an astragal depth that substantially matches a depth from an interior surface of the first door jamb to a screen plane.

6. The multi-panel door system of claim 1, further comprising a sill screen track fixed to the sill of the door frame, the sill screen track being spaced above the sill of the door frame to form a gap that allows moisture to flow underneath the sill screen track, the sill screen track including bristles located within the gap, the bristles being adapted to pass moisture and block insects.

7. A multi-panel door system comprising:

a door frame including a first doorjamb, a second doorjamb, a sill, a head, and an astragal located between the first door jamb and the second doorjamb;

a fixed panel placed between the first door jamb and the astragal, the fixed panel being secured to the door frame by one or more securement members driven through a middle section of the astragal and into the fixed panel and by an insert member located between the fixed panel and the first door jamb, wherein the fixed panel includes a channel that receives the insert member and thereby releasably secures the fixed panel to the first door jamb and wherein the fixed panel is configured to pivot into place between the first door jamb and the astragal using the insert member; and a vent panel placed between the second door jamb and the astragal, the vent panel being pivotally secured to the astragal through one or more hinges that are fixed to the middle section of the astragal wherein the fixed panel is secured in a recessed position between an exterior-facing surface of the first door jamb and an interior-facing surface of the first door jamb in which an interior-facing surface of the fixed panel is coplanar with an interior-facing surface of the vent panel when the vent panel is in a closed position with respect to the door frame and wherein the fixed panel is secured in the recessed position without using visible fixed stops.

8. The multi-panel door system of claim 7, wherein the fixed panel is configured to pivot around the insert member when moving into place between the first door jamb and the astragal.

9. The multi-panel door system of claim 7, wherein the fixed panel is releasably secured to the first door jamb without extending permanent screws or nails through the first door jamb and into the fixed panel.

10. The multi-panel door system of claim 7, wherein the insert member is a first insert member and wherein the fixed panel is secured to the door frame through a second insert member located between the fixed panel and the astragal.

11. The multi-panel door system of claim 7, wherein the insert member is configured to form a tongue-in-groove joint with the fixed panel.

12. The multi-panel door system of claim 7, wherein the insert member is hidden from external view when the fixed panel is placed between the first door jamb and the astragal.

13. A multi-panel door system comprising:

a door frame including a first doorjamb, a second doorjamb, a sill, a head, and an astragal located between the first door jamb and the second doorjamb;

a fixed panel placed between the first door jamb and the astragal, the fixed panel being secured to the door frame by one or more securement members that are each driven both through a middle section of the astragal and into the fixed panel and by an insert member located between the fixed panel and the first door jamb, wherein the insert member provides a securing force for the fixed panel between the first door jamb and a side of the fixed panel adjacent the first door jamb so that the fixed panel may be removed from the frame by removing the one or more securement members from the fixed panel and rotating the fixed panel away from the door frame; and a vent panel placed between the second door jamb and the astragal, the vent panel being pivotally secured to the astragal through one or more hinges that are fixed to the middle section of the astragal wherein an exterior facing surface of the fixed panel lies in a first plane, an interior facing surface of the fixed panel lies in a second plane, and wherein the insert member is completely located between the first plane and the second plane when the fixed panel is placed between the first door jamb and the astragal.

* * * * *